US006908414B1

(12) United States Patent
Roadman

(10) Patent No.: US 6,908,414 B1
(45) Date of Patent: Jun. 21, 2005

(54) INTERACTIVE TREADMILL

(76) Inventor: Lee A. Roadman, R.D. 1, Box 153-B Dillon Rd., Acme, PA (US) 15610

( * ) Notice: Subject to any disclaimer, the term of this patent is extended or adjusted under 35 U.S.C. 154(b) by 169 days.

(21) Appl. No.: 10/033,788

(22) Filed: Jan. 3, 2002

Related U.S. Application Data

(60) Provisional application No. 60/292,954, filed on Jun. 6, 2001.

(51) Int. Cl.[7] ..... A63B 21/00
(52) U.S. Cl. ..... 482/51; 248/200; 482/8
(58) Field of Search ..... 482/1–9, 51, 54, 482/900–902; 248/250, 279.1

(56) References Cited

U.S. PATENT DOCUMENTS

| | | | | |
|---|---|---|---|---|
| 1,919,627 A | | 7/1933 | Fitz Gerald | 482/52 |
| 4,976,424 A | * | 12/1990 | Sargeant et al. | 482/8 |
| 5,240,215 A | * | 8/1993 | Moore | 248/279.1 |
| 5,810,696 A | | 9/1998 | Webb | 482/52 |
| 5,813,947 A | | 9/1998 | Densmore | 482/51 |
| 5,984,839 A | | 11/1999 | Corkum | 482/54 |
| 6,021,535 A | * | 2/2000 | Baus et al. | 5/632 |
| 6,283,896 B1 | * | 9/2001 | Grunfeld et al. | 482/54 |
| 6,387,015 B1 | * | 5/2002 | Watson | 482/54 |

OTHER PUBLICATIONS

CRUNCH logs On With Netpulse, Sep. 1, 1998, pp. 1 and 2.*

* cited by examiner

*Primary Examiner*—Glenn E. Richman
(74) *Attorney, Agent, or Firm*—Patent & Trademark Services, Inc; Thomas Zack; Joseph H. McGlynn

(57) ABSTRACT

A built-in, or add-on, accessory mounted to a conventional exercising device to allow the user to have access to the Internet while exercising. The built-in version includes the conventional exercising device controls with an added computer keyboard. The accessory added to an existing conventional exercising device includes a computer keyboard on a platform with brackets which allow for the attachment of the platform to the exercising device, and for the adjustment of the platform with respect to the exercising device.

12 Claims, 2 Drawing Sheets

INTERACTIVE TREADMILL

This invention claims the benefit of the U.S. Provisional application 60/292,954 filed on Jun. 6, 2001.

BACKGROUND OF THE INVENTION

This invention relates to a device for an existing treadmill that may either be built into the treadmill or added as an accessory, and which allows the user to access the Internet while using the treadmill.

Treadmills have long been used to provide exercise to a user, usually indoors. Many of the treadmills are powered to move the foot pad or tread on which the user walks or runs. In one earlier invention, the treadmill had a control box which responded to the position of the user on the treadmill.

One exercise invention, a step exerciser, had a television attached to the front of the exerciser.

Another treadmill related invention has a desk which is placed over the front portion of the treadmill.

Still another invention discloses a computer which is adapted to be attached to a treadmill.

DESCRIPTION OF THE PRIOR ART

Exercise devices are known in the prior art. For example, U.S. Pat. No. 1,919,627 to FitzGerald discloses a treadmill with a control box which responds to the position of the user on the treadmill.

U.S. Pat. No. 5,810,696 to Webb discloses a step exerciser which has a television attached to the front of the exerciser.

U.S. Pat. No. 5,813,947 to Densmore discloses a desk which is placed over the front portion of the treadmill.

U.S. Pat. No. 5,984,839 to Corkum discloses a computer which is adapted to be attached to a treadmill.

In the present invention a built-in component, or an add-on accessory, is combined with a conventional treadmill to allow a user to access the Internet while exercising. The add-on accessory, or built-in component, comprises a platform for supporting a computer with supporting brackets attached to the treadmill and computer. These brackets allow the platform to be vertically adjusted and angled relative to the treadmill.

SUMMARY OF THE INVENTION

This invention relates to an accessory or built-in component that is mounted to a conventional treadmill to allow the user access to the Internet while exercising on the treadmill.

It is the primary object of the present invention to provide for an improved treadmill which allows the user to both exercise and access the Internet at the same time.

Another object is to provide for such an accessory whether attached to or built into the treadmill, wherein a computer keyboard is supported by a platform with adjustment brackets interconnecting the treadmill to the platform.

These and other objects and advantages of the present invention will become apparent to readers from a consideration of the ensuing description and the accompanying drawings.

DESCRIPTION OF THE PREFERRED EMBODIMENT

Figure 1:
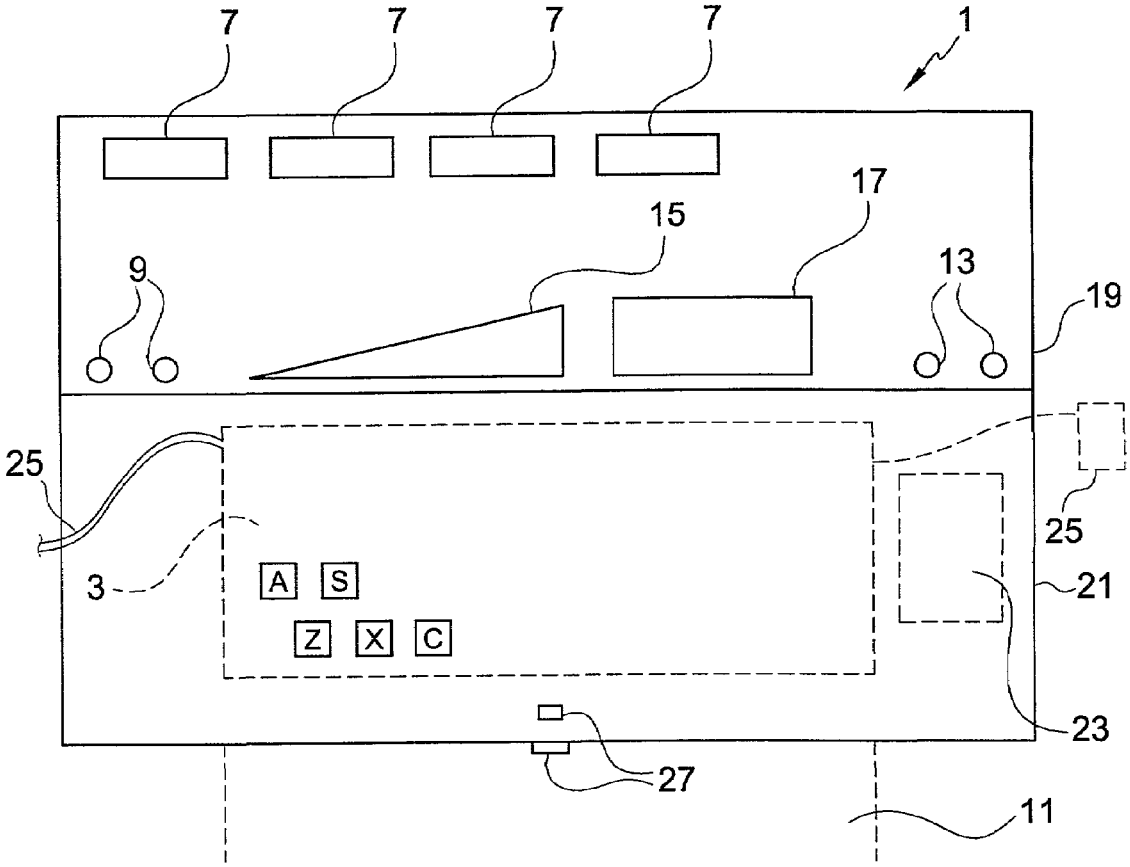
FIG. 1 is a top view of a built-in platform for a conventional treadmill which supports a computer keyboard.

FIG. 1 is a top view of the platform 1 which supports the computer keyboard 3, shown in dotted line format, and the various operator controls and readouts gauges 7, 15, 17 for the treadmill. The platform may be built into the existing treadmill during the manufacturing process and sold with the treadmill. The platform 1 consists of two generally flat surfaces 19, 21 joined together at an angle (see FIG. 2) with the upper surface having the conventional controls and readouts gauges 7, 9, 13, 15, 17 normally associated with a power driven treadmill. Among these components are the gauge cluster 7, the up/down controls 9, to change the elevation of the movable treadmill mat 11 (partially, shown in dotted line format), the speed controls 13 for increasing or decreasing the speed of rotation of the treadmill mat 11, the readout 15 to indicate the angular orientation of the treadmill surface with respect to the ground, and the readout 17 giving the distance in miles a user has walked or run during the exercise cession. All of the controls and gauges on the upper part 19 of the platform 1 are conventional in design and may vary depending on the manufacturer of the treadmill and the particular controls and features incorporated into its design.

On the lower horizontally disposed portion 21 of the platform 1 is a surface adapted to receive the conventional computer keyboard 3 (some of whose keys are shown) and its associated mouse pad and mouse 23. It should be noted that the above components are given merely for illustrational purposes, and other components such as, but not limited to, a trackball could also be used by the user to access the Internet. The computer keyboard 3 is operatively connected to the CPU (central processing unit) via cable 25 and the CPU is connected to the Internet via a telephone line or the like. Since these components are conventional, no description is necessary or will be given. Thus, a user of the computer, using the keyboard 3, may have access to the Internet while the treadmill foot pad 11 rotates to provide exercise for the user.

At the lower center of platform 21 are control switches 27 used to control the treadmill 11 in an emergency situation, or just to shut off the electrical power used to move the treadmill. The control switches 27 are conventional in design and may include a tether attached to the user which will be dislodged and stop the treadmill should the user fall.

Figure 2:
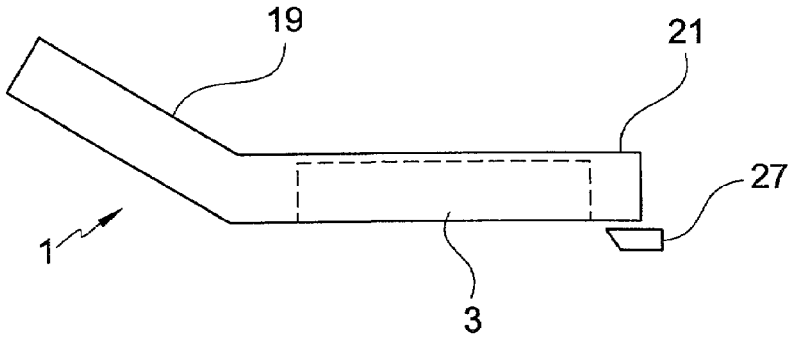
FIG. 2 is a side view of the FIG. 1 platform.

FIG. 2 is a side view of the FIG. 1 platform 1. As indicated, this platform could be built into and sold with the treadmill. The upwardly slanting angular configuration of the upper platform portion 19 relative to the lower horizontal portion 21 is more clearly visible in this view. The conventional computer keyboard 3 may sit in a recessed portion of the lower horizontal portion 21 and is shown in dotted line format. The emergency and other controls 27 extend slightly out from the lower bottom of portion 21 to allow for access by a user of the treadmill.

Figure 3:
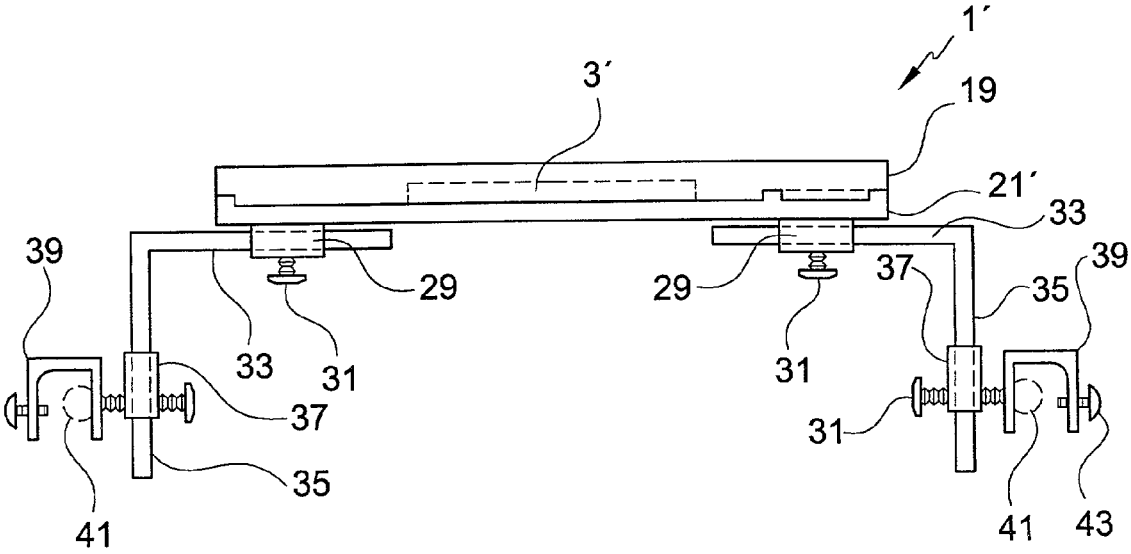
FIG. 3 is a side view of an add-on accessory platform showing the supporting brackets for the platform.

FIG. 3 is a side view of an add-on accessory platform 1' which may be added on to the frame rails of an existing conventional treadmill. When the same components are used in this add-on accessory, they have the same numbers with a prime added to those shown in FIGS. 1 and 2. Four spaced bracket holders 29, two of which are shown, are fixed to the underside of platform portion 21'. The bracket holders 29 have thumb screws 31 with a threaded screw portion that engage the surface of the horizontal bracket sections 33. At right angles to sections 33 are the vertical bracket sections 35. Mounted on sections 35 are sleeves 37 with thumb screws 31. The sleeves 37 may be moved up and down along the length of sections 35 and are fixed in position by the thumb screws 31. The sleeves 37 allow for the vertical adjustment of the platform 21' relative to the treadmill.

Extending outwardly from the sleeves 37 and the sections 35 are two U-shaped clamps 39. The clamps 39 fit on side frame members 41, shown in dotted line format, of the conventional treadmill. To adjust the angular orientation of the bracket sections 35, and hence their attached platform 1', relative to the treadmill, thumb screws 43 are used. After the user moves the platform to its desired angular orientation, each of the screws 43 is tightened onto the frame members 41 of the treadmill, thereby fixing the platform in that desired orientation.

Figure 4:
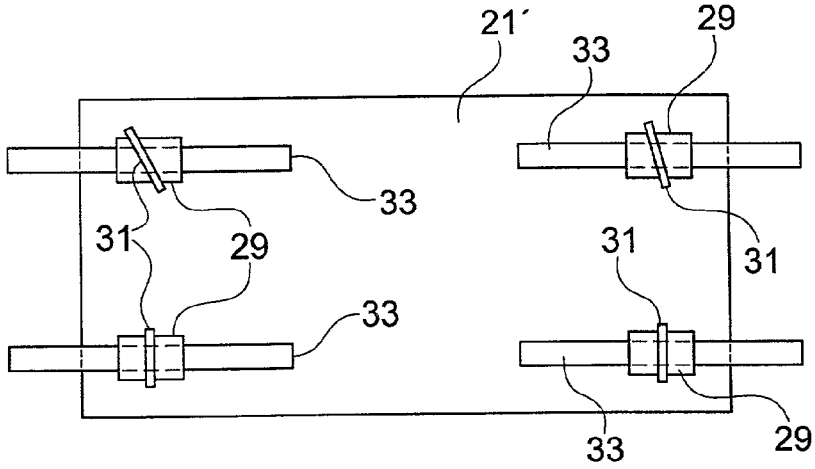
FIG. 4 is a bottom view of the FIG. 3 platform showing four bracket holders.

FIG. 4 is a bottom view of the FIG. 3 add-on platform portion 21', showing four spaced bracket holders 29 used to hold the horizontal bracket sections 33 as shown. Holders 29 each have hollow interiors and a thumb screw 31 which, when turned, has a screw that can engage the bracket section 33 within the holder 29. Each of the sections 33 are joined at right angles to vertical bracket section 35, (see FIG. 3). Since there is a certain amount of custom fitting of the brackets 29 to the particular frame or other holding structure of the conventional treadmill, the exact number of bracket sections and engaging clamps can vary. The important thing is that the platform can be both vertically adjusted, relative to the treadmill, and also have its angular orientation adjusted with respect to the treadmill. Other bracket configuration may also be possible to accomplish the same dual adjustment of the supported platform by the brackets and their attached clamps, etc.

While disclosed for use with a treadmill, any type of exercising device could be used with the present invention.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. The combination of an accessory for an exercising device and an exercising device comprising:

an exercising device, an accessory having means for mounting a game device on said exercising device, said game device having a computer device, said means for mounting the game device comprising a platform, brackets attached to said exercising device, said brackets also being attached to said platform, a computer keyboard connected to the computer device and connected to the Internet, said computer keyboard being used for inputting instructions to the computer to operate said game device, and means for adjusting said brackets relative to the exercising device in two different directions, and wherein each of said brackets have a horizontally disposed section and a vertically disposed section, said bracket holders being mounted to said horizontally disposed section of said bracket, and each of said bracket holders being fixed to said bottom of said platform, and wherein said vertically disposed section of each bracket has a sleeve movable along said vertically disposed section, and a clamp mounted by a pivotal connection to said movable sleeve, said exercising device having a frame member on which said clamp is mounted, and said means for adjusting said brackets relative to said exercising device in two different directions is said sleeve and said clamp.

2. The combination as claimed in claim 1, wherein there are four spaced bracket holders fixed to said platform.

3. The combination as claimed in claim 2, wherein each of said brackets have a horizontally disposed section and a vertically disposed section, said bracket holders being mounted to said horizontally disposed section of said bracket, and each of said bracket holders being fixed to said bottom of said platform.

4. The combination as claimed in claim 3, wherein said vertically disposed section of each bracket has a sleeve movable along said vertically disposed section, and a clamp mounted by a pivotal connection to said movable sleeve, said exercising device having a frame member on which said clamp is mounted, and said means for adjusting said brackets relative to said exercising device in two different directions is said sleeve and said clamp.

5. The combination as claimed in claim 4, wherein there are four bracket holders, each of said bracket holders being spaced from other bracket holders, each bracket holder receiving a horizontally disposed section of said bracket, and means on each bracket holder for engaging said horizontally disposed section of the bracket.

6. The combination as claimed in claim 5, wherein said means on each bracket holder for engaging said horizontally disposed section of the bracket is screw threaded.

7. The combination as claimed in claim 1, wherein said exercising device is a treadmill.

8. The combination of an accessory for an exercising device and an exercising device comprising:

an exercising device, an accessory, means for mounting the accessory to said exercising device, said accessory having a computer device with a keyboard for inputting instructions to the computer device, said computer device being connected to the Internet, said means for mounting the accessory having a platform, said platform having a bottom, brackets attached to said exercising device, said brackets being attached to said bottom of said platform by bracket holders, said brackets also being attached to said platform, and means for adjusting said brackets relative to the exercising device in two different directions, and wherein there are four spaced bracket holders fixed to said platform, and wherein each of said brackets have a horizontally disposed section and a vertically disposed section, said bracket holders being mounted to said horizontally disposed section of said bracket, and each of said bracket holders being fixed to said bottom of said platform, and wherein said vertically disposed section of each bracket has a sleeve movable along said vertically disposed section, and a clamp mounted by a pivotal connection to said movable sleeve, said exercising device having a frame member on which said clamp is mounted, and said means for adjusting said brackets relative to said exercising device in two different directions is said sleeve and said clamp.

9. The combination as claimed in claim 8, wherein each of said brackets have a horizontally disposed section and a vertically disposed section, said bracket holders being mounted to said horizontally disposed section of said bracket, and each of said bracket holders being fixed to said bottom of said platform.

10. The combination as claimed in claim 9, wherein said vertically disposed section of each bracket has a sleeve movable along said vertically disposed section, and a clamp mounted by a pivotal connection to said movable sleeve, said exercising device having a frame member on which said clamp is mounted, and said means for adjusting said brackets relative to said exercising device in two different directions is said sleeve and said clamp.

11. The combination as claimed in claim 9, wherein there are four bracket holders, each of said bracket holders being spaced from other bracket holders, each bracket holder receiving a horizontally disposed section of said bracket, and means on each bracket holder for engaging said horizontally disposed section of the bracket.

12. The combination as claimed in claim 11, wherein said means on each bracket holder for engaging said horizontally disposed section of the bracket is screw threaded.

* * * * *